US006726252B1

(12) United States Patent
Chaikel et al.

(10) Patent No.: US 6,726,252 B1
(45) Date of Patent: Apr. 27, 2004

(54) COMPUTER-CONTROLLED IDENTIFIER TAG PRODUCTION SYSTEM

(75) Inventors: Neil Chaikel, Vancouver (CA); Miguel Jensen Didulo, Vancouver (CA)

(73) Assignee: Illen Products Ltd., Vancouver (CA)

( * ) Notice: Subject to any disclaimer, the term of this patent is extended or adjusted under 35 U.S.C. 154(b) by 0 days.

(21) Appl. No.: 09/461,361

(22) Filed: Dec. 15, 1999

(51) Int. Cl.[7] ..... B42D 15/00

(52) U.S. Cl. ..... 283/74; 40/299.01; 40/360; 40/642.02; 283/61; 283/81; 283/105; 283/109

(58) Field of Search ..... 40/299.01, 360, 40/642.02, 649, 661.04; 283/74, 75, 81, 103, 105, 109–111, 61, 62

(56) References Cited

U.S. PATENT DOCUMENTS

| | | | | | |
|---|---|---|---|---|---|
| 3,407,523 | A | | 10/1968 | Winston | 40/1.5 |
| 3,619,573 | A | * | 11/1971 | Philip et al. | 235/487 |
| 4,033,611 | A | | 7/1977 | Johnsen | 283/16 |
| 4,110,502 | A | | 8/1978 | Baer | 428/40 |
| 4,183,159 | A | | 1/1980 | Isaac | 40/1.6 |
| 4,184,275 | A | | 1/1980 | Thornell | 40/1.5 |
| 4,236,331 | A | | 12/1980 | Mattson | 40/1.5 |
| 4,459,772 | A | | 7/1984 | Kanzelberger | 40/152.1 |
| 4,484,401 | A | | 11/1984 | Pitts | 40/2 |
| 4,597,206 | A | | 7/1986 | Benson | 40/1.5 |
| 5,031,939 | A | | 7/1991 | Webendorfer | 283/81 |
| 5,224,600 | A | | 7/1993 | Neugebauer | 206/449 |
| 5,329,711 | A | * | 7/1994 | Dewey | 283/2 |
| 5,398,435 | A | | 3/1995 | Kanzelberger | 40/1.5 |
| 5,410,827 | A | | 5/1995 | Smith | 40/1.5 |
| 5,678,863 | A | * | 10/1997 | Knight et al. | 283/109 |
| 5,699,326 | A | * | 12/1997 | Haas et al. | 368/327 |
| 5,769,457 | A | * | 6/1998 | Warther | 283/61 |
| 5,873,606 | A | * | 2/1999 | Haas et al. | 283/75 |
| D413,353 | S | * | 8/1999 | Robertson et al. | D19/1 |
| 5,997,683 | A | * | 12/1999 | Popat | 156/253 |
| 6,039,356 | A | * | 3/2000 | Warther et al. | 283/61 |
| 6,086,107 | A | * | 7/2000 | Whistler et al. | 281/81 |
| 6,142,531 | A | * | 11/2000 | Harris, II | 283/74 |

FOREIGN PATENT DOCUMENTS

| | | |
|---|---|---|
| EP | 0 488 813 A2 | 6/1992 |
| EP | 0 876 928 A | 11/1998 |
| FR | 2 757 145 | 6/1998 |
| WO | WO 95/34879 | 12/1995 |

OTHER PUBLICATIONS http://www.qvc.com, "Acid Free Transparent Vellum Paper & Sticker Set", 1995.*

Cawley Co. brochure, "Quality Name Plates and Recognition Products by Cawley", 1991.

Imprint Plus brochure, "Now Imprinting Your Company Nametags Is As Easy As Typing A Name", 1996.

* cited by examiner

*Primary Examiner*—Monica S. Carter
(74) *Attorney, Agent, or Firm*—Oyen Wiggs Green & Mutala

(57) ABSTRACT

A computer-controlled identifier tag production system. The system employs perforated plastic sheets comprising a plurality of transparent identifier tags. The sheets are designed to be fed through a conventional ink jet or laser printer to print one or more of the tags in accordance with user input. Each sheet is a single layer in thickness and is sufficiently flexible and heat-stable such that it will not deform if passed through a printer multiple times. The printed tags are used in conjunction with a plastic holder and backer plate to form an adhesive-free identifier tag assembly. The backer plate is preferably a rigid metal plate which may be embossed with indicia, such as a corporate logo. The identifier tag assembly may further include a magnet or pin fastener for temporarily affixing the backer plate to an article of clothing.

13 Claims, 8 Drawing Sheets

COMPUTER-CONTROLLED IDENTIFIER TAG PRODUCTION SYSTEM

FIELD OF THE INVENTION

This application relates to a computer-controlled identifier tag production system. The system employs perforated plastic sheets comprising a plurality of transparent tags. The sheets are designed to be fed through a conventional ink jet or laser printer to print one or more of the tags in accordance with user input. The printed tags are then separated from the remainder of the sheet and used in conjunction with a plastic holder and backer sheet to form an adhesive-free identifier tag assembly wearable on an article of clothing.

BACKGROUND OF THE INVENTION

Temporary name tags are required for many social and business events. The most rudimentary name tags are paper labels having an adhesive backing. Attendees simply handwrite their name on a label and affix it to an article of clothing. Alternatively, sheets of adhesive labels may be fed through a desktop printer controlled by a computer processor to create computer-generated name tags having a consistent appearance. In order to avoid the use of adhesives, it is also commonplace to create computer-generated name tags on sheets of plain paper which are then cut or divided along tear lines to produce individual name tags suitable for insertion into plastic holders. Such holders are then typically affixed to an article of clothing with a pin or clip or are suspended from a strap worn around the user's neck.

Many businesses having staff members dealing with the public require name tags which are sufficiently durable for long-term wear and which project a more professional appearance than conventional paper labels. For many years the applicant has sold metal identifier tags customized to meet this market demand. The identifier tags may be screen-printed with the name and/or title of the staff member together with a corporate logo. Such metal identifier tags are releasably held in place on an article of clothing with a small magnet to avoid the disadvantages of adhesives or pin fasteners. While such identifier tags are very durable and project a very professional appearance, they are relatively expensive to manufacture and are not readily reusable. This poses problems for companies having a large staff turn-over.

In order to meet this concern, the applicant has previously developed an identifier tag production system using a pen plotter controlled by a software application. The plotter is programmed to apply ink directly to a metal identifier tag in accordance with data inputted by the user. The ink is formulated so that it is readily removable from the metal surface using suitable solvents. This permits customers to remove names, titles or other printed indicia from the metal identifier tags and reuse the tags as their staffing roster changes. However, one drawback of this system is that it requires that each customer purchase a pen plotter and custom templates for holding the identifier tags in the preferred alignment in the plotter during the printing process.

Another approach known in the prior art to produce custom identifier tags is to print employee indicia on a flexible plastic film which is then affixed to a more rigid backing plate. For example, U.S. Pat. No. 5,398,435 dated Mar. 21, 1995, Kanzelberger, relates to a method of making plastic plates which may be adorned with graphics to make such things as badges, name tags, desk plates, wall plaques and the like. According to the Kanzelberger method, a transparent Mylar sheet may be printed with information using a printer controlled by a microprocessor The transparent Mylar sheet is then laid on top of a separate information-carrying sheet (which may be embossed, for example, with a corporate logo). The various sheets are maintained in their preferred orientation using adhesives. For example, a double-sided pressure sensitive adhesive tape may be applied to the bottom of the Mylar sheet. The use of adhesives to hold the assembly of graphic material together restricts the capacity of the user to remove the information-carrying Mylar sheet and substitute alternative information (such as a new name or job title).

Kanzelberger also obtained a patent in the United States on Jul. 17, 1984 (U.S. Pat. No. 4,459,772) specifically relating to debossable plastic name tags and plaques. Embodiments of the invention are described employing transparent folders or envelopes for aligning underlying graphic displays. However, the assembly of graphic material is held together with adhesives.

U.S. Pat. No. 4,236,331 dated Dec. 2, 1980, Mattson, discloses a magnetic badge assembly comprising an outer panel and an inner panel, each comprising magnetic material, such as magnetic tape. Each of the panels may also include a thin metal plate. The magnetic tape and metal plate, which form the core of each panel, are enclosed in a laminated plastic film jacket comprising a pair of thermofusable plastic sheet material sections. An indicia-carrying sheet may be either attached to the outer face of the panel or laminated within the plastic jacket. The outer indicia-carrying sheet may be equipped with a pressure sensitive adhesive so that it may be removed and replaced with another sheet. However, such a sheet would be prone to fraying and would not be sufficiently durable for long-term use. In the case of the embodiment laminated within the interior of the plastic jacket, it is not intended to be removable.

U.S. Pat. No. 4,597,206 dated Jul. 1, 1986, Benson, discloses a snap-together badge and clip to be worn on a person's clothing as a name badge, display button or the like. Display material bearing information is sandwiched between a substantially transparent element and a backplate. Thus, the display element is removable and is maintained in the proper alignment with the other pieces of the cover assembly. However, Benson does not teach the advantages of producing the display element in an automated manner using a conventional desktop printer.

U.S. Pat. No. 4,183,149 dated Jan. 15, 1980, Isaac, discloses a portable transparent display device which is reusable. The Isaac display device primarily comprises two separate elements, namely a transparent cover and an insertable element, which may be flexed to insert or remove the element from a recessed space defined by the cover. An information-carrying sheet of material may be inserted into, and is aligned within, the recessed space. Isaac contemplates that the insertable element may be clear or opaque, but he does not teach the advantages of producing the insert in an automated manner using a conventional desktop printer.

U.S. Pat. No. 4,184,275, Thornell, similarly discloses a reusable badge which is assembled by snapping a backing plate into a transparent lens. Display material is removably placed between the lens and the backing member.

While some reusable identifier tags and badges are known in the prior art, they are not specifically adapted for holding transparent tag inserts created using conventional desktop printers or for maintaining such inserts in a preferred alignment without the use of adhesives. The need has therefore arisen for an identifier tag production system which overcomes the various limitations of the prior art in a cost-effective manner while still yielding durable identifier tags having a professional appearance.

SUMMARY OF THE INVENTION

In accordance with the invention, an identifier tag assembly is provided comprising (a) an optically clear holder having a cavity formed therein; (b) a backer sheet sized to fit snugly in the cavity; and (c) an identifier tag having indicia printed thereon, wherein the tag is positionable in the cavity between the holder and the backer sheet, and wherein the tag is held in alignment with the backer sheet without the use of adhesives.

Preferably the tag comprises a single layer of flexible plastic film. The backer sheet may consist of a rigid metal plate. The plate may bear indicia which is visible through the holder and printed tag when the holder, tag and backer sheet are assembled together.

An identifier tag production system is also provided comprising (a) a computer processor; (b) a storage device connected to the computer processor, the storage device storing software for controlling the processor and for storing identifier tag data inputted by a user; (c) a printer adapted to receive the identifier tag data from the computer processor and output the data to an output medium; (d) at least one sheet subdividable into a plurality of identifier tags, wherein the sheet is adapted to pass through the printer to receive the identifier tag data outputted by the printer.

Preferably, the sheet comprises a single layer of plastic film having perforated tear lines separating the tags. The film is sufficiently flexible and heat-stable such that it may pass through the printer multiple times without substantially deforming.

The invention also relates to a flexible sheet comprising a single layer of material capable of bearing printed indida, the sheet having leading and trailing ends and opposed side edges, wherein the sheet is at least partially sub-divided into a plurality of tags arranged in rows between the leading and trailing ends, wherein each of the rows is separated by a perforated tear line extending transversely across the sheet at least part-way between the side edges.

Preferably the sheet comprises a first portion proximate the trailing end and a second portion comprising the remainder of the sheet, wherein the tear lines extend across the entire width of the sheet in the first portion and only part-way across the sheet in the second portion, thereby defining non-perforated side margins in the second portion.

The sheet is used as part of a method for producing a reusable identifier tag assembly comprising (a) providing computer software operable with a computer processor, wherein the software is adapted to receive and store identifier tag data inputted by a user; (b) providing a computer printer connected to the computer processor and configured to receive the identifier tag data; (c) providing an identifier tag sheet subdividable into a plurality of identifier tags; (d) passing the sheet through the printer to print the identifier tag data on at least one of the identifier tags, thereby producing a printed tag; (e) retrieving the sheet from the printer and removing the printed tag from the remainder of the sheet; (f) providing an optically clear tag holder having a cavity formed therein and a rigid backer sheet adapted to fit snugly in the cavity; and (g) inserting the printed tag into the holder cavity together with the backer sheet to form a wearable identifier tag assembly.

An identifier tag production kit is disclosed comprising (a) computer software operable with a computer processor, wherein the software is adapted to receive and store identifier tag data inputted by a user; (b) a plurality of sheets subdividable into a plurality of identifier tags; and (c) a plurality of identifier tag holder assemblies, each of the assemblies comprising (i) an optically clear holder having a cavity formed therein; (ii) a rigid backer sheet adapted to fit snugly into the cavity; and (iii) a fastener for detachably coupling the backer sheet to an article of clothing.

BRIEF DESCRIPTION OF THE DRAWINGS

In drawings which illustrate preferred embodiments of the invention, but which should not be construed as restricting the spirit or scope of the invention in any way.

DETAILED DESCRIPTION OF THE PREFERRED EMBODIMENT

Figure 1:
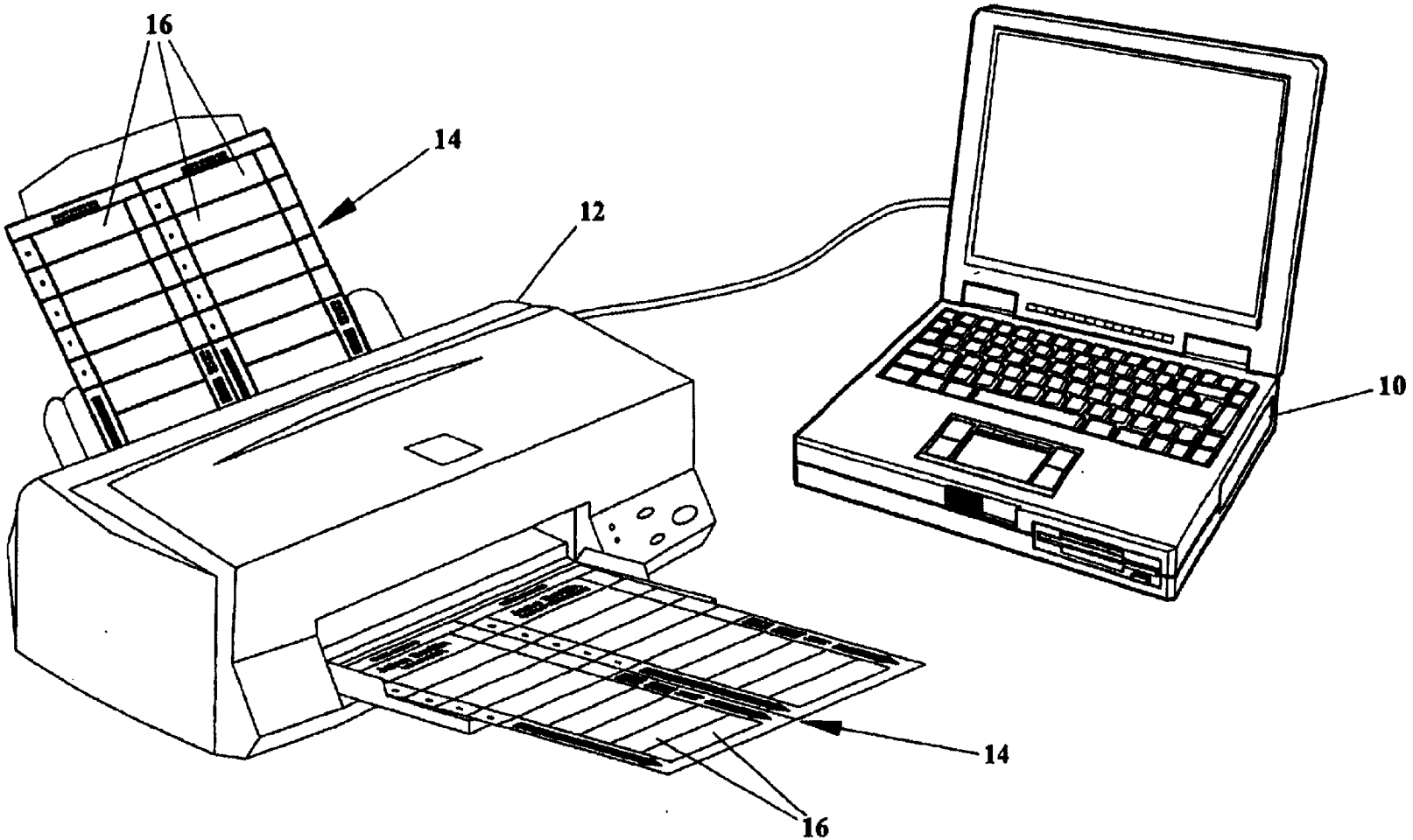
FIG. 1 is schematic view of the applicant's identifier tag production system comprising software running on a personal computer, a conventional desktop printer and perforated plastic identifier tag sheets adapted to be fed through the printer.

This application relates to a customizable identifier tag production system. As shown in FIG. 1, the system utilizes a personal computer 10 running computer software programmed to control the operation of a conventional ink jet or laser printer 12. Identifier tag sheets 14, consisting of a single layer of transparent plastic, are fed through printer 12 to produce printed identifier tags 16 which may then be torn away from the remainder of sheet 14. As shown best in FIG. 5, each printed tag 16 may then be inserted into a plastic holder 18 together with a rigid backer sheet 20 to form a wearable identifier tag assembly 22.

Figure 2A:
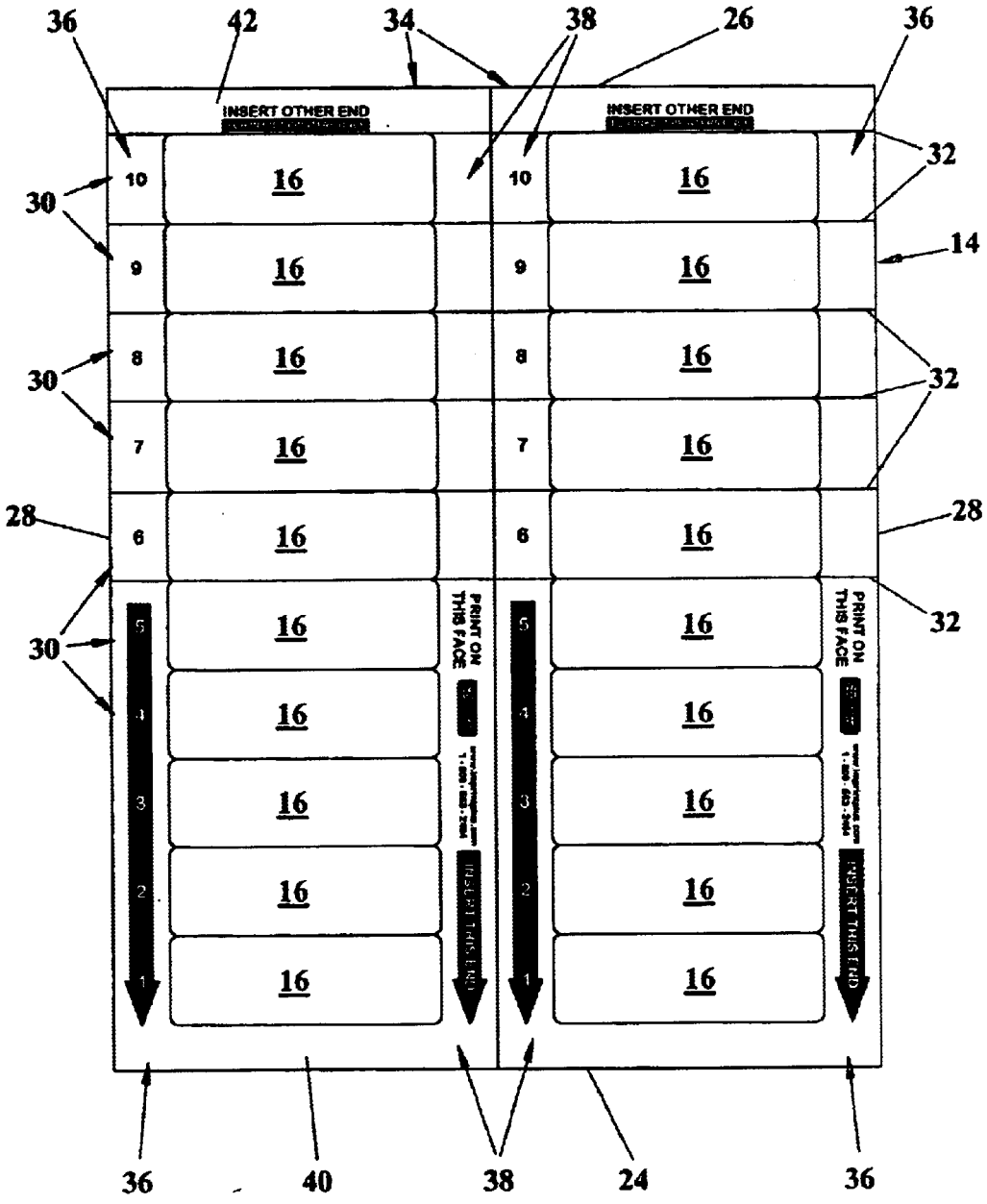
FIG. 2*a* is a top plan view of a blank identifier tag sheet.

FIG. 2*a* illustrates a blank identifier tag sheet 14. Sheet 14 includes a leading end 24, a trailing end 26 and side edges 28. In the illustrated embodiment, tags 16 are arranged in parallel rows 30 between ends 24, 26 and are separated by transversely extending perforated tear lines 32. As will be apparent to a person skilled in the art, the layout of sheet 14 may vary depending upon the size, shape and quantity of tags 16 desired. In the illustrated embodiment, sheet 14 comprises two parallel columns 34 of tags 16. Tags 16 are centered in each column 34 to define a side margin 36 extending adjacent a side edge 28 of sheet 14 and a central webbing 38 extending adjacent to the longitudinal centerline of sheet 14. Sheet 14 also includes margins 40 and 42 adjacent the leading and trailing ends 24 and 26 of sheet 14 respectively.

Figure 2B:
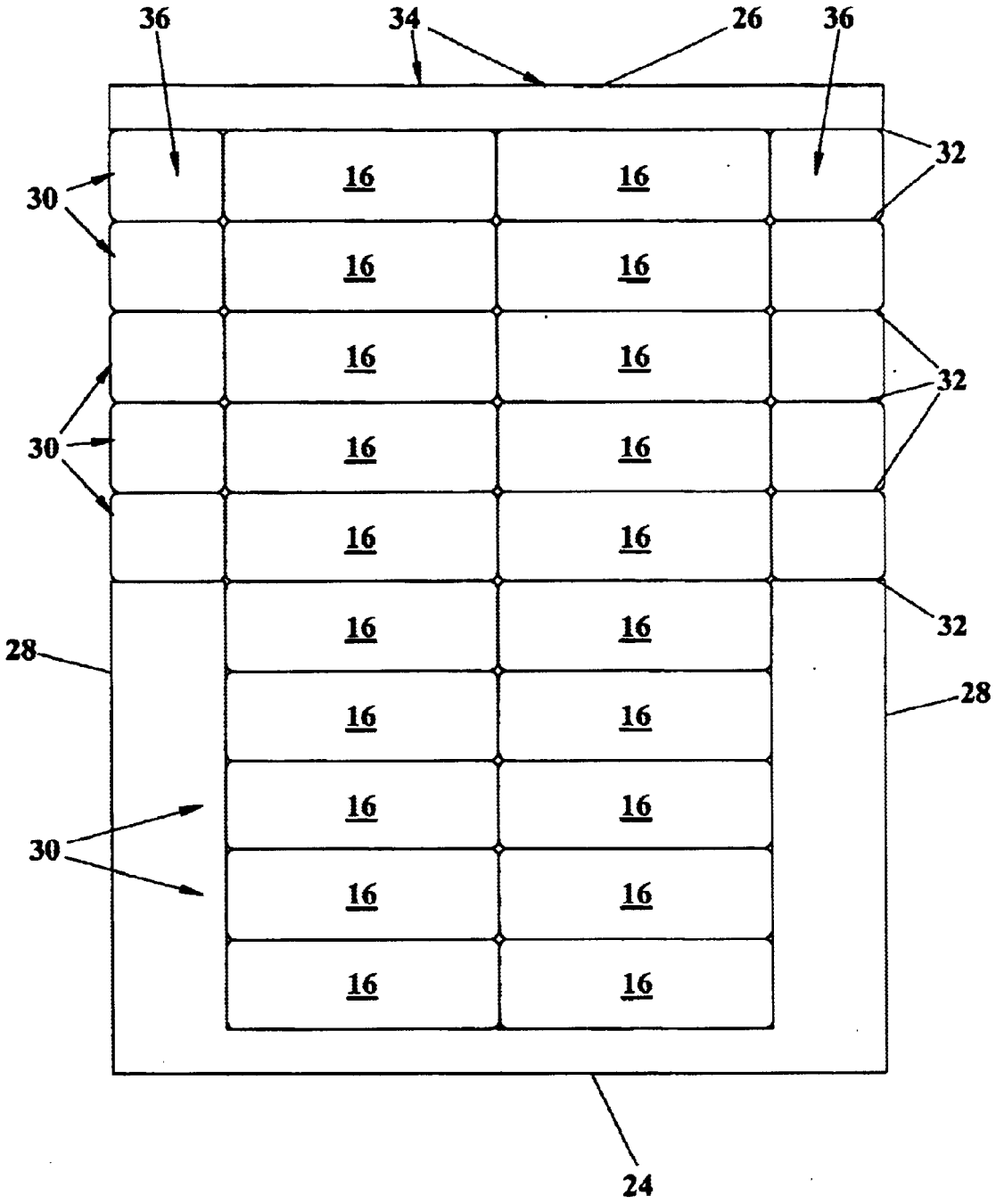
FIG. 2*b* is a top plan view of an alternative embodiment of a blank sheet.

In an alternative embodiment of the invention illustrated in FIG. 2*b*, labels 16 in adjacent columns 34 meet along the longitudinal centerline of sheet 14 and central webbing 38 is omitted. Many other possible alternative layouts for sheet 14 may be envisioned as indicated above.

In a further alternative embodiment (not shown) sheet 14 could comprise a single tag 16 surrounded by a perforated margin. This embodiment would be suitable, for example, for signs or desk plaques.

Each sheet 14 is preferably constructed from a thin single layer of transparent plastic suitable for use in either an ink jet or laser printer 12 (i.e. capable of accepting either water-based inks delivered by ink jet printers or toner delivered by laser printers). By way of example, coated polyester sheets available from Arkwright Incorporated are suitable for ink jet printers. For laser printers, MELINEX™ sheets available from Dupont Corporation are suitable. As discussed further below, it is an important feature of the invention that sheets 14 are heat-stabilized and are capable of being fed through printer 12 multiple times without significantly deforming. Accordingly, conventional plastic sheets used for overhead transparencies and the like are not suitable.

The perforation pattern of tear lines 32 on sheet 14 is preferably created using a custom die cutter (not shown). As shown in FIGS. 2*a* and 2*b*, tear lines 32 extend transversely across the entire width of sheet 14 in the trailing half of sheet 14 (i.e. from a central portion of sheet 14 to trailing end 26). In the leading half of sheet 14 (i.e. from a central portion of sheet 14 to leading end 24) tear lines 32 do not extend into side margins 36. As explained further below, this ensures that sheet 14 is a minimum acceptable length for use in printers 12 to avoid printer jams and sheet misalignments.

Figure 2C:
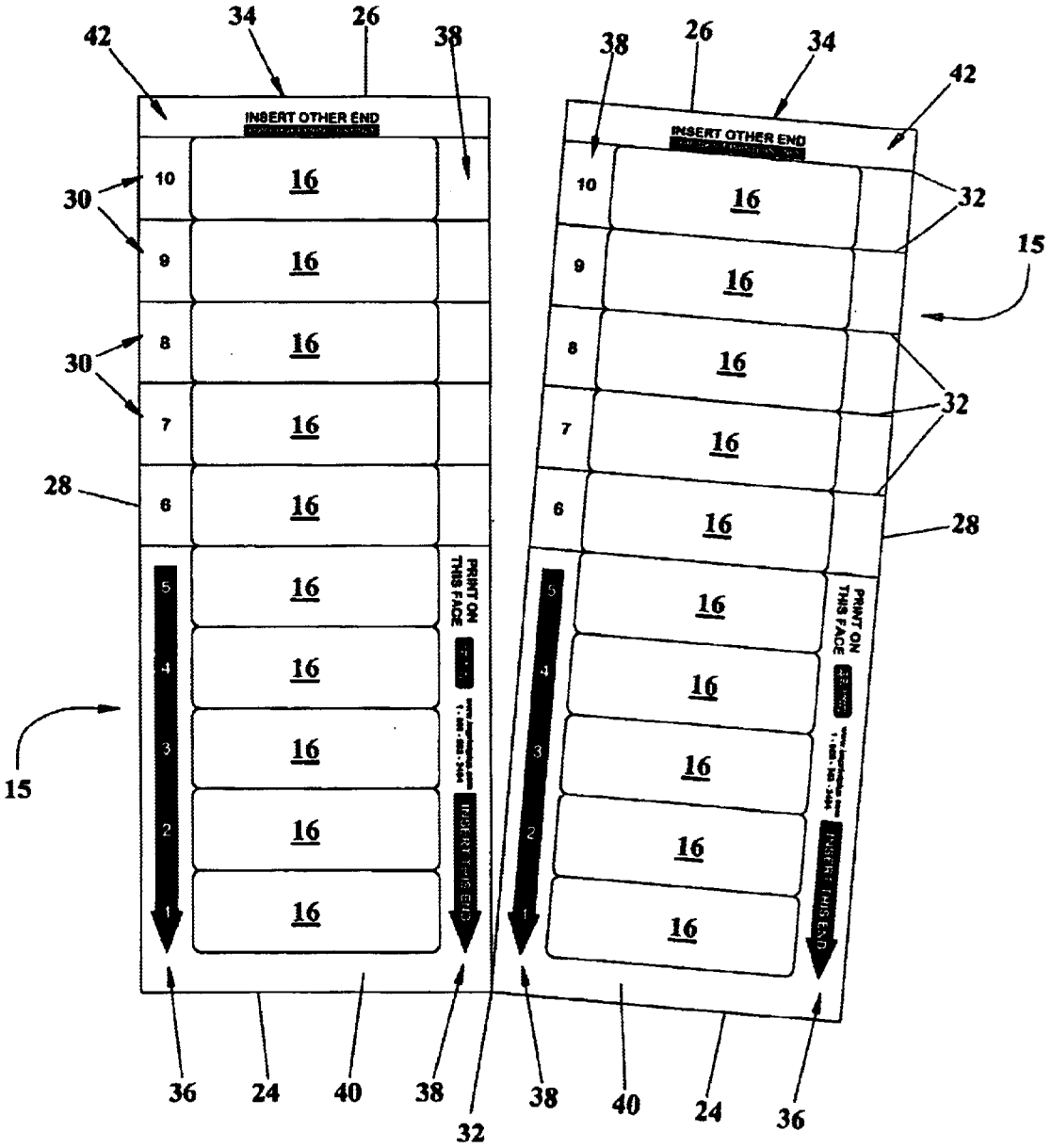
FIG. 2*c* is a top plan view of the sheet of FIG. 2*a* separated along its longitudinal centerline to form two separate subsheets.
Figure 3:
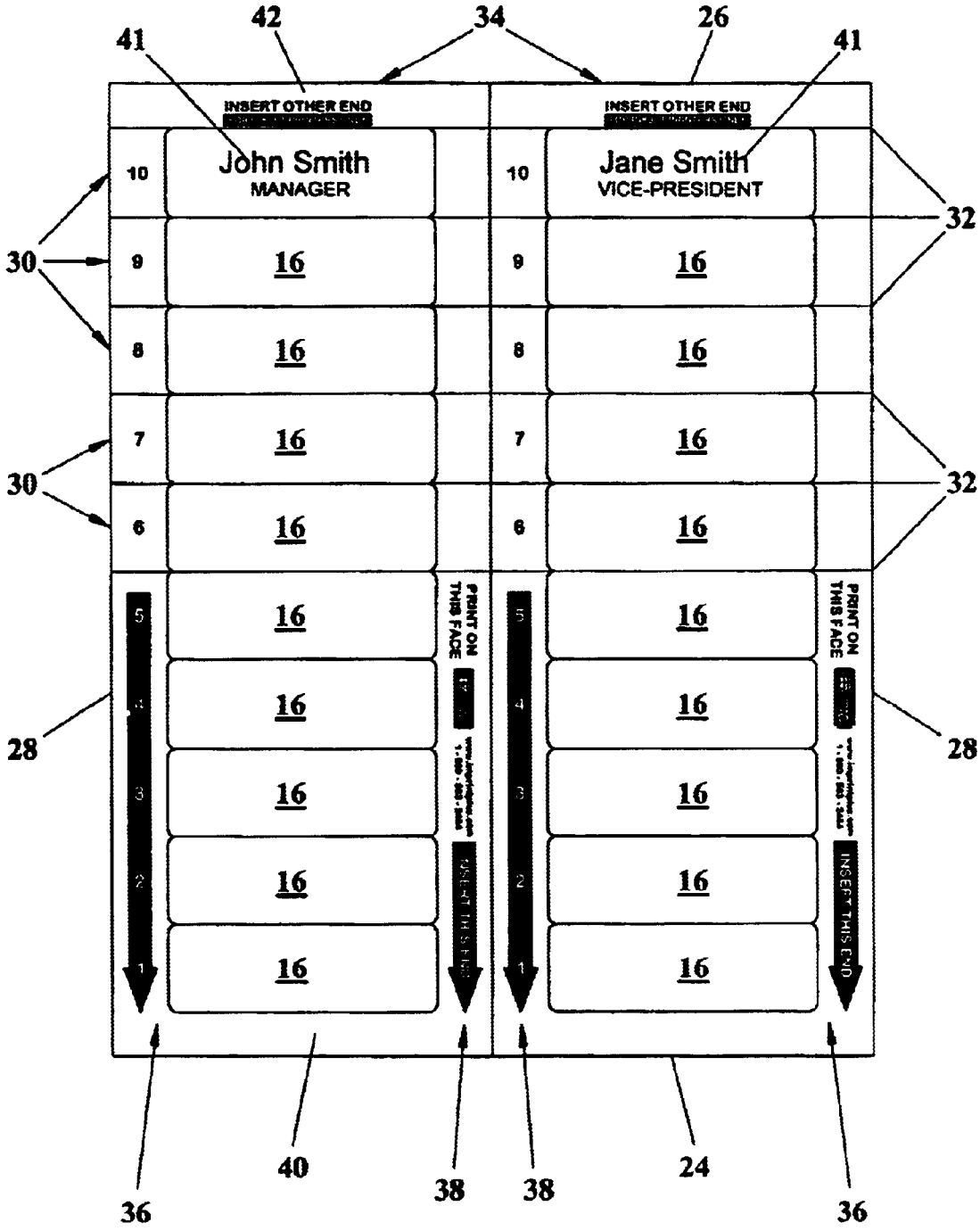
FIG. 3 is a top plan view of the sheet of FIG. 2*a* partially printed with one row of identifier tags.

As shown in FIG. 2*c*, sheet 14 may be torn along a central longitudinal perforation line to form two separate subsheets 15. Each subsheet 15 may be fed through printer 12 in the same manner as a conventional envelope.

In use, sheets 14 are printed in a manner generally similar to conventional sheets of paper labels having adhesive backings. The applicant's system includes software running on computer 10 designed to process and store user input, such as the name and title of each individual for whom an identifier tag is required, or other similar identifying information. Preferably the software includes an initial set-up utility for configuring the system to match the features of the particular printer 12 or other output device to be used. For example, the size and position of the printer input tray, feed rollers and internal transport mechanism may vary depending upon the model in question. The set-up utility prompts the user to print test print jobs using plain paper and then make any necessary adjustments to calibrate the software to the output device specifications.

For example, in one embodiment, the set-up utility prompts the user to print a sample sheet of plain paper bearing calibration lines. A blank identifier tag sheet 14 is then laid over top of the plain paper to compare the position of tags 16 relative to the calibration lines. The software may then be appropriately adjusted until the position of tags 16 and the calibration lines are aligned. This ensures that any indicia 41 printed on tags 16 will not be off-center or otherwise askew. For example, if identifier tags 16 are used as part of a name tag assembly, it is critical that the name and title of the employee be precisely centered in order to convey a professional aesthetic impression.

After the initial set-up and input of identifier tag data or other indicia to be printed, sheets 14 are loaded into the input tray of printer 12 as shown in FIG. 1. It is imperative that leading end 24 of sheet 14 be fed into printer 12 first. The applicant's software is configured to print tags 16 at locations on sheet 14 measured relative to leading end 24. In order to prevent misalignments, leading end 24 should preferably be square, straight and the full width of the printer infeed.

Figure 4:
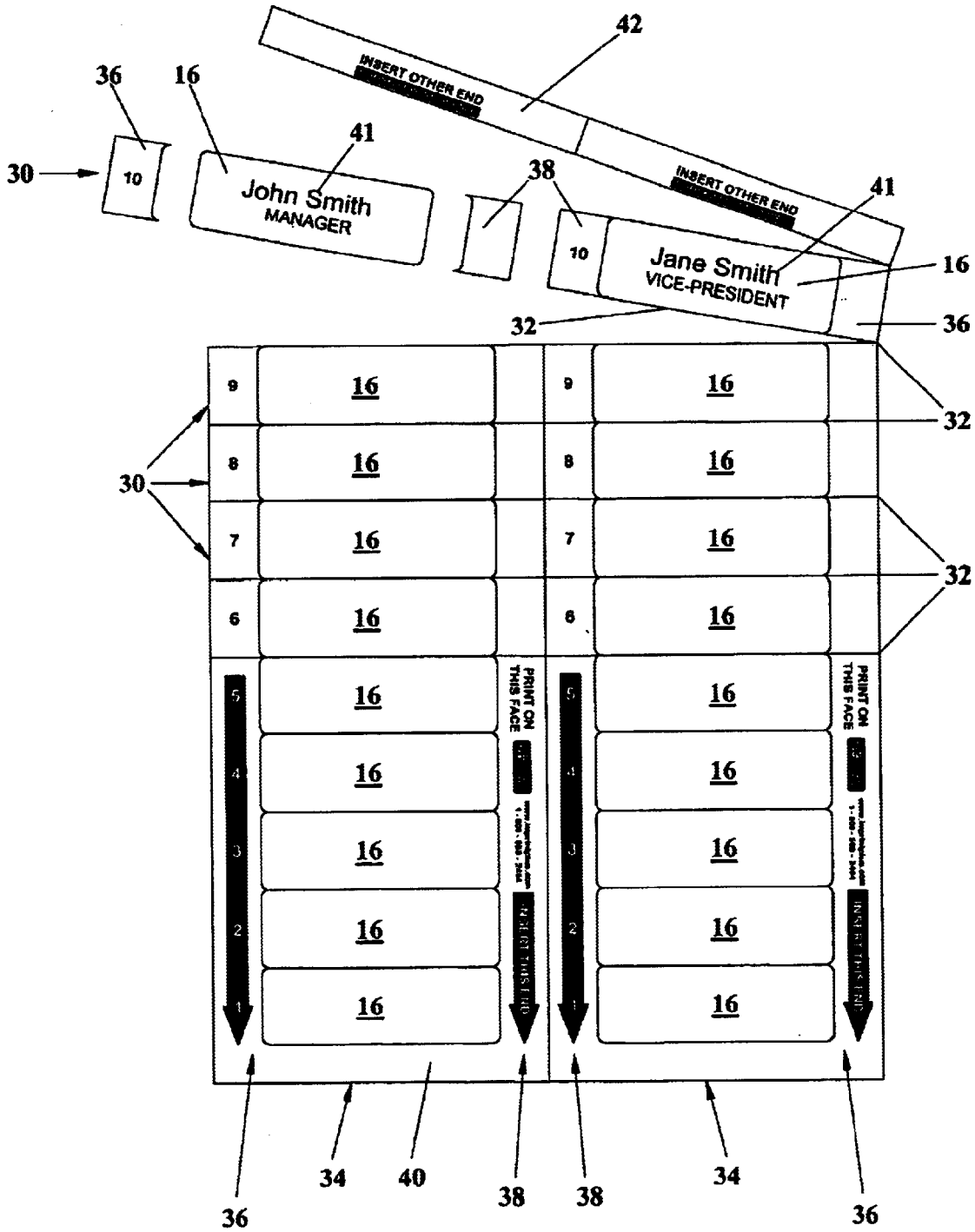
FIG. 4 is a top plan view of the sheet of FIG. 3 illustrating the row of identifier tags torn away from the remainder of the sheet.

Sheet 14 is printed in a conventional manner by printer 12 and is deposited into the feeder output tray (FIG. 1). In the illustrated example, two identifier tags 16 are printed in the row 30 closest to trailing end 26. As shown in FIG. 4, the trailing end margin 42 together with the row 30 closest to trailing end 26 are then separated from the remainder of sheet 14 along tear lines 32. This results in a partially-used sheet 14 which is similar in structure to the original blank sheet 14 except that it is shorter in length. The partially-used sheet of FIG. 4 may be reused on multiple occasions. Accordingly, if it is necessary to produce only a few identifier tags 16, the user need not be concerned that he or she will waste an entire sheet 14 of tags 16.

Each time sheet 14 is used, an entire row 30 of tags 16 is removed. This ensures that the new trailing end 26 of the partially-used sheet is square, straight and extends across the full width of sheet 14 to prevent conflicts with the "paper out" sensors of printer 12. However, many printers 12 have minimum sheet length requirements due to internal distances between printer transport rollers. Accordingly, the perforation pattern of sheet 14 has been configured so that sheet 14 may not be divided along tear lines 32 into less than half its length. As discussed above, this is achieved by not extending tear lines 32 into side margins 36 in the leading half of sheet 14 (i.e. label rows 1–5 in the illustrated embodiment).

Many printers 12 also have minimum sheet width requirements. Such printers 12 only allow for a minimum sheet width to be fed (i.e. envelope width). Accordingly, the perforation pattern of sheet 14 has also been configured to ensure that it may not be subdivided into less than half its width. For example, in the illustrated embodiment, only two columns 34 are provided divided by a tear line 32 extending along the longitudinal centerline of sheet 14. As shown in FIG. 2*c*, sheet 14 may be subdivided longitudinally along the central tear line 32 into two separate subsheets 15. Each subsheet 15 may be individually passed through printer 12 using the envelope feed. For example, if a user wishes to print only a single tag 16, a subsheet 15 could be used to ensure that no tags 16 are wasted when the printed tag 16 is removed (as indicated above, after a tag 16 is printed, the entire row of tags 16 is removed to ensure that the trailing edge of the remainder of sheet 14 or subsheet 15 is straight).

In the applicant's system, identifier tags 16 are always printed from the trailing end 26 of sheet 14, or subsheet 15, toward the leading end 24. Thus the leading end margin 40 is maintained to prevent printing misalignment (i.e. end 24 serves as a reference for the sheet sensors of printer 12 irrespective of whether any identifier tag rows 30 are removed in the trailing half of the sheet). This feature is the opposite of conventional printing sequences which begin at the leading end of a sheet and print toward the trailing end.

Figure 5:
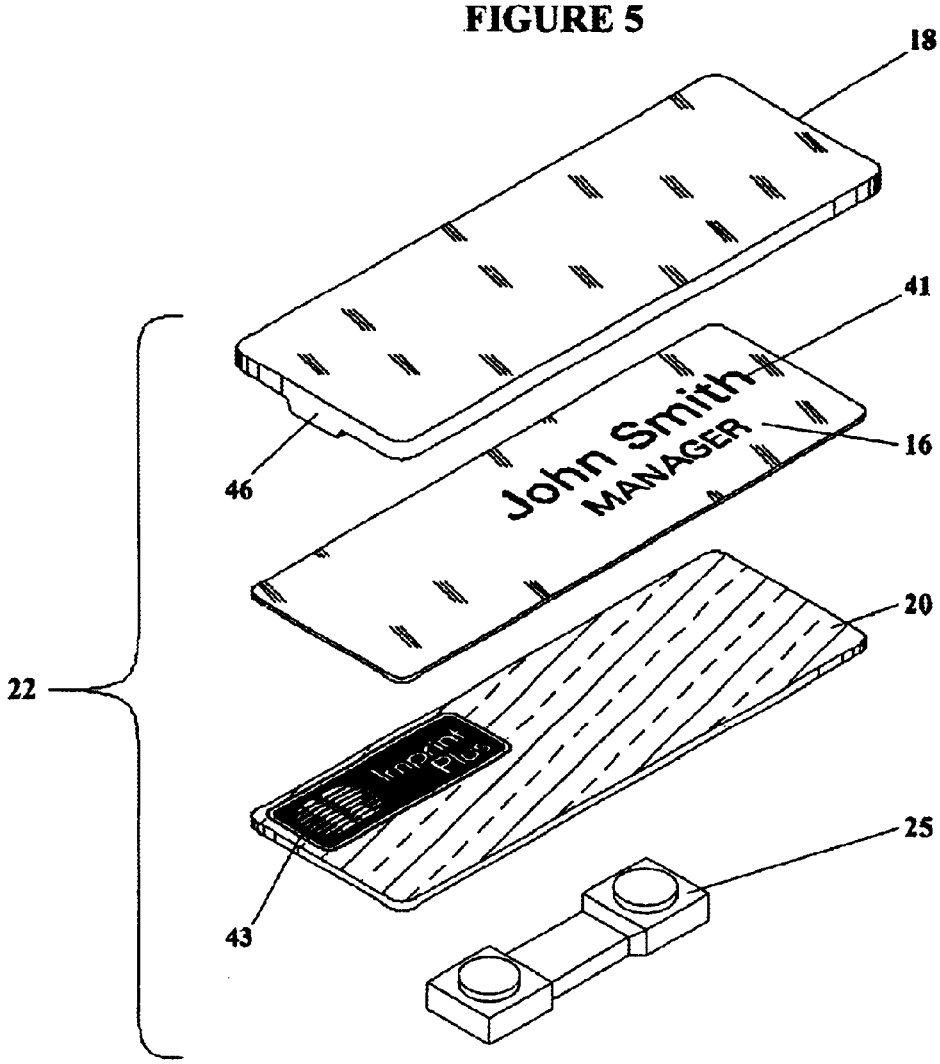
FIG. 5 is an top isometric exploded view of an identifier tag assembly comprising an optically clear holder for receiving a printed identifer tag and a backer sheet.

As shown in FIG. 4, each printed tag 16, now bearing indicia 41, is separated along tear lines 32 from the attached side margin 36 and central webbing 38 and is ready for use as part of an identifier tag assembly 22. With reference to FIG. 5, printed tag 16 is sandwiched between holder 18 and backer sheet 20. An important feature of the applicant's invention is that tag 16 is held in alignment in assembly 22 without the use of adhesives.

Figure 6:
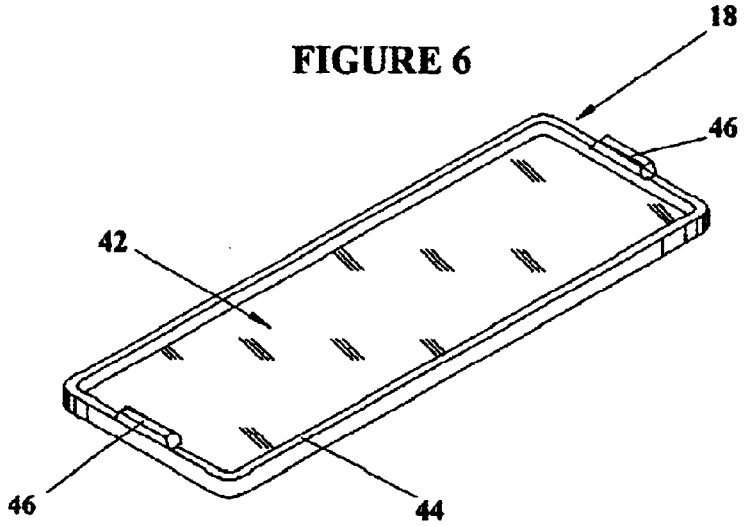
FIG. 6 is a bottom isometric view of the holder of FIG. 5.
Figure 7:
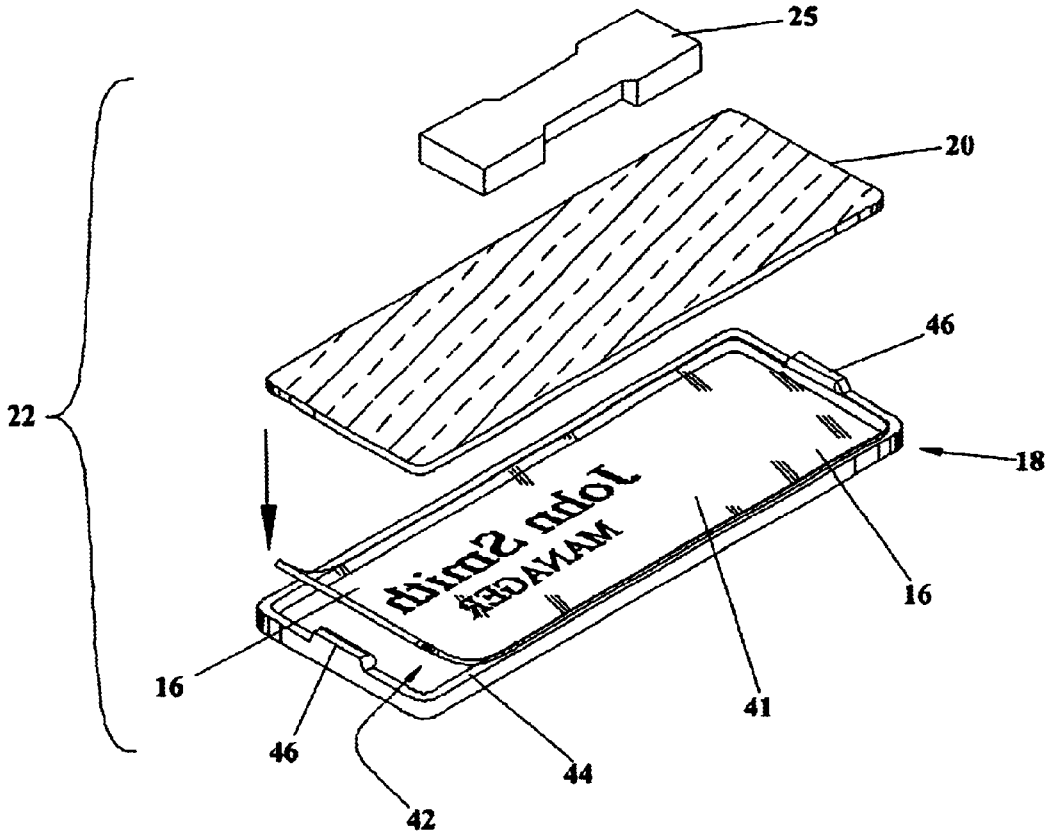
FIG. 7 a bottom isometric exploded view of the identifier tag assembly of FIG. 5.
Figure 8:
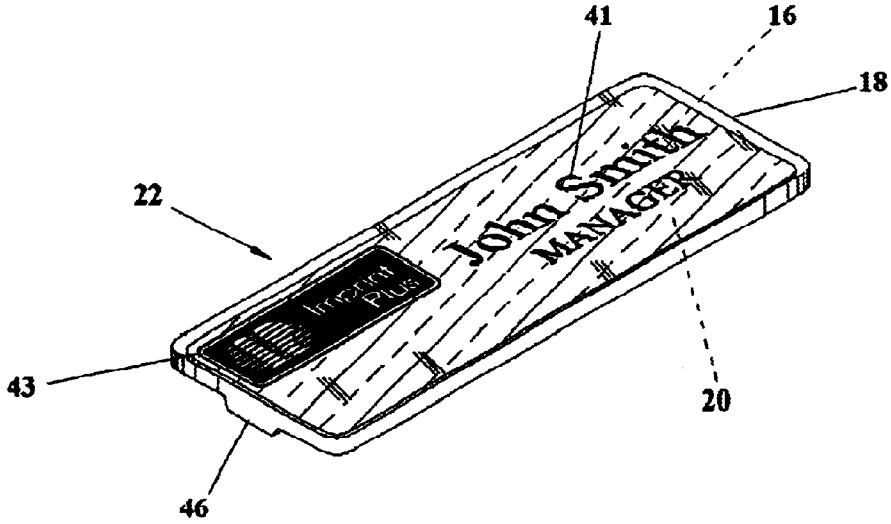
FIG. 8 is a top isometric view of the identifier tag assembly of FIG. 5 in its assembled configuration.

As shown best in FIGS. 6 and 7, the bottom surface of holder 18 has a cavity 42 formed therein defined by a peripheral rim 44. The shape and size of cavity 42 preferably matches the shape and size of tag 16 and backer sheet 20. Holder 18 also includes inwardly-projecting flexible tabs 46 located at opposite ends of holder 18. In use, tag 16 is inserted into holder cavity 42 together with backer sheet 20 as shown in FIG. 7. Tabs 46 engage the side edges of backer sheet 20 to securely hold assembly 22 together. FIG. 8 illustrates assembly 22 in the fully assembled configuration In one embodiment of the invention, backer sheet 20 may consist of a rigid piece of coloured metal plate. This would enable name tag assembly 22 to be held in position on an article of clothing using a magnet. Alternatively, backer sheet 20 may comprise a conventional pin or equivalent fastener.

Since tag 16 is preferably transparent (apart from the indicia 41 printed thereon) it is not readily detectable when assembled together with backer sheet 20 and holder 18 as shown in FIG. 7. Rather, in the assembled configuration of FIG. 8, the visual effect that is created is that indicia 41 is printed directly on backer sheet 20. Backer sheet 20 may be screenprinted with other indicia, such as corporate logos or the like, to enhance the visual effect. As will be apparent to a person skilled in the art, backer sheet 20 may also be produced in different background colours to create different visual effects. Holder 14 may include a magnifying lens or a custom contour to also enhance the readability of the name tag assembly 22 or to vary other visual effects.

As will be apparent to a person skilled in the art, in alternative embodiments of the invention tags 16 may be non-transparent (e.g. translucent, opaque or bearing solid designs) to create other visual effects.

An important advantage of the applicant's invention is that the printed tag 16 may be easily removed from assembly 22 and replaced with another tag 16. For example, if the name or position of an employee changes, the old tag 16 may be removed from assembly 22 and discarded and a new tag 16 bearing the correct indicia 41 may be substituted. Since no adhesives are used, the applicant's system does not result in a sticky and potentially unsightly residue on backer sheet 20. This feature is particularly attractive to large companies using customized backer sheets 20 (for example, metal plates bearing a corporate logo) and having a large amount of staff turnover. The applicant's invention enables such customers to retain the custom backer sheets 20 and print substitute tags 16 on demand quickly and easily using conventional desktop printers 12.

As will be apparent to a person skilled in the art, the applicant's invention may also be sold as a kit to the general consumer market. Such a kit could include the application software, a supply of blank sheets 14, a supply of plastic holders 18 and a supply of backer sheets 20 and fasteners (such as magnets). The kit would also include detailed instructions explaining how to load the software and run the initial set-up operation as well as how to print custom identifier tags 16 as discussed above.

In an alternative embodiment of invention, sheet 14 may be printed in a non-perforated format and then cut to size using a custom hand-operated die cutter sold to customers as part of the overall system. In still another embodiment, sheets 14 may be suitable for use in output devices other than conventional printers, such as pen plotters.

Although this invention has been described in relation to wearable identifier tag assemblies 22, the same principles would apply in creating wall plaques, desk plaques, badges and the like.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A flexible sheet comprising a single layer of material free of adhesives and capable of bearing printed indicia, said sheet having leading and trailing ends and opposed side edges, wherein said sheet is at least partially sub-divided into a plurality of tags arranged in rows between said leading and trailing ends, wherein each of said rows is separated by a perforated tear line extending transversely across said sheet at least part-way between said side edges, wherein said sheet comprises a first portion proximate said trailing end and a second portion comprising the remainder of said sheet, wherein said tear lines extend across the entire width of said sheet in said first portion and only part-way across said sheet in said second portion, thereby defining non-perforated side margins in said second portion.

2. The sheet of claim 1, wherein said sheet is sufficiently flexible and heat-stable that it may be passed through a printer multiple times without substantially deforming.

3. The sheet of claim 2 comprising a substantially transparent plastic film.

4. The sheet as defined in claim 1, wherein said tags are arranged contiguously.

5. The sheet as defined in claim 1, wherein said sheet is capable of passing through a desktop computer printer to print said indicia thereon after one or more of said tags have been removed from said sheet.

6. An identifier tag assembly comprising:

(a) an optically clear holder having a cavity formed therein;

(b) a backer sheet sized to fit snugly in said cavity; and (c) a tag derived from a sheet as defined in claim 1 and having indicia printed thereon, wherein said tag is positionable in said cavity between said holder and said backer sheet, said tag being held in alignment with said backer sheet without the use of adhesives, wherein at least part of said backer sheet is visible through said holder and said tag.

7. The assembly as defined in claim 6, wherein said tag comprises a single layer of plastic film capable of passing through a desktop printer multiple times without substantially deforming.

8. The assembly of claim 6, wherein said tag is substantially transparent.

9. The assembly of claim 6, wherein said backer sheet is rigid.

10. The assembly of claim 4, wherein said backer sheet is metal.

11. The assembly of claim 6, wherein said backer sheet comprises indicia visible through said holder and said tag.

12. The assembly of claim 6, wherein said backer sheet and said tag are substantially the same size.

13. The assembly of claim 6, wherein said holder comprises means for detachably affixing said holder to an article of clothing.

* * * * *